United States Patent [19]

Raque et al.

[11] Patent Number: 4,791,775

[45] Date of Patent: Dec. 20, 1988

[54] PACKAGING DEVICE

[75] Inventors: Glen Raque; Edward A. Robinson, both of Louisville, Ky.

[73] Assignee: Raque Food Systems, Inc., Louisville, Ky.

[21] Appl. No.: 41,860

[22] Filed: Apr. 28, 1987

[51] Int. Cl.[4] ..... B65B 31/04; B65B 31/02

[52] U.S. Cl. ..... 53/510; 53/110

[58] Field of Search ..... 53/403, 432, 433, 110, 53/510, 511

[56] References Cited

U.S. PATENT DOCUMENTS

| | | | |
|---|---|---|---|
| 2,869,301 | 1/1959 | Stover | 53/110 |
| 3,274,746 | 9/1966 | James et al. . | |
| 3,360,382 | 12/1967 | Miller . | |
| 3,481,100 | 12/1969 | Bergstrom . | |
| 3,540,186 | 11/1970 | Parvin et al. . | |
| 3,659,393 | 5/1972 | Richter . | |
| 3,695,900 | 10/1972 | Young et al. . | |
| 3,820,300 | 6/1974 | Reinecke et al. | 53/110 |
| 3,902,302 | 9/1975 | Tartarini | 53/511 |
| 3,992,850 | 11/1976 | Vetter | 53/510 |
| 4,009,552 | 3/1977 | Schlachter . | |
| 4,058,953 | 11/1977 | Sanborn, Jr. et al. . | |
| 4,294,859 | 10/1981 | Lundquist et al. . | |
| 4,409,252 | 10/1983 | Buschkens et al. . | |
| 4,472,924 | 9/1984 | Vogele et al. | 53/511 |
| 4,624,099 | 11/1986 | Harder | 53/510 |
| 4,642,239 | 2/1987 | Ferrar et al. . | |

*Primary Examiner*—Horace M. Culver

*Attorney, Agent, or Firm*—Barnes & Thornburg

[57] ABSTRACT

An apparatus for packaging an item in a controlled atmosphere enclosure is provided. The apparatus includes a conveyor for continuously conveying a series of containers along a defined path. The path has sequentially oriented first and second portions, and defines a first side border and an opposite second side border. The apparatus introduces a covering material over the path of containers such that a space is created between the containers and the moving covering material. A vacuum gallery is disposed substantially adjacent the first border for applying a vacuum to the space only in the first portion of the path. A gas gallery is disposed substantially adjacent the second border for continuously introducing a selected gas into the space in both the first portion and the second portion of the path. The apparatus also includes a sealing head for mating and sealing the containers with a corresponding section of the moving covering material in the second portion of the path to form a controlled atmosphere environment enclosure.

17 Claims, 2 Drawing Sheets

PACKAGING DEVICE

BACKGROUND AND SUMMARY OF THE INVENTION

The present invention relates to devices for packaging selected items More particularly, the present invention relates to devices for continuously packaging selected items in a controlled atmosphere enclosure.

It is known to package items, specifically selected food items, in packages having a controlled atmosphere. Normally, this controlled atmosphere is a low oxygen atmosphere, with the oxygen replaced by an inert gas. Such controlled atmosphere enclosures or packages are necessary to insure adequate shelf life for many of the selected food items. By eliminating the majority of oxygen from the package, the shelf life of the food item is greatly increased.

Normally, the controlled atmosphere within the package is obtained in one of two conventional ways. First, machines have been adapted to simply introduce the inert gas into the stationary package, with the inert gas partially displacing the ambient oxygen in the package. After the inert gas is introduced, the package is sealed. This method has generally proved unsatisfactory because it is extremely difficult to lower the oxygen content within the package to a desirable level, and it is extremely slow.

The second method of achieving a controlled atmosphere in the package has been by utilizing a vacuum in combination with a gas flush machine. In such a conventional machine, the package is placed in a vacuum chamber which creates a vacuum in the package. After the vacuum has been created in the package, the selected gas is introduced into the package, and the package is then sealed. Some conventional vacuum gas flush devices also introduce a vacuum through one side of the package, while the selected gas is introduced through the opposite side of the package. However, all of the conventional vacuum gas flush devices utilize a vacuum chamber to perform these functions. In all of these devices, it is necessary for the package to stop for a period of time in the vacuum chamber. Thus, none of the conventional vacuum gas flush devices is capable of continuously conveying a series of packages, with the controlled atmosphere introduced into the package and the package sealed without stopping any of the packages. Production using conventional devices is slow an therefore expensive.

One object of the present invention is to provide a controlled atmosphere packaging device that is capable of creating a controlled atmosphere within a package, and is also capable of sealing the package to maintain that selected controlled atmosphere.

Another object of the present invention is to provide a controlled atmosphere packaging device that is capable of creating a controlled atmosphere within the package without the use of a vacuum chamber to enclose the package for a period of time.

Yet another object of the present invention is to provide a controlled atmosphere packaging device that is capable of packaging selected items with a controlled atmosphere within the package in a continuous manner.

According to the present invention, an apparatus for packaging an item in a controlled atmosphere enclosure is provided. The apparatus comprises means for continuously conveying a series of containers along a defined path. The path has sequentially oriented first and second portions, and defines a first side border and an opposite second side border. The apparatus also has means for introducing a covering material move the path of containers such that a space is created between the containers and the covering material. Means disposed substantially adjacent the first border are provided for applying a vacuum to the space only in the first portion of the path. Means disposed substantially adjacent the second border are provided for continuously introducing a selected gas into the space in both the first portion and in the second portion of the path. The apparatus also has means for mating and sealing the containers with a corresponding section of the covering material in the second portion of the path to form a controlled atmosphere environment enclosure.

One feature of the foregoing structure is that the apparatus has means for continuously conveying a series of containers along the path. One advantage of this feature is that it is not necessary to stop the package in the machine in order to introduce the controlled atmosphere into the package.

Another feature of the foregoing structure is that the covering material that is used to cover the containers is oriented such that a space is created between the containers and the covering material. One advantage of this feature is that the area in which the vacuum is applied and the gas is introduced is defined by the moving containers and moving covering material. This eliminates the necessity for any additional vacuum chamber into which the vacuum is applied.

In preferred embodiments of the present invention, the path includes a first end configured to receive the series of containers, and the apparatus further includes second gas supply means disposed substantially adjacent the first end of the path and extending between the first and second side borders. The second gas supply means is configured to introduce gas into the first end of the path so that the gas is able to communicate with an interior region of each of the containers as the containers enter the path through the first end.

One feature of the foregoing structure is that an additional gas supply means is disposed across the first end of the path for introducing the selected gas into each container as it enters the path. One advantage of this feature is that the selected gas is first introduced directly into each container which aids in initially eliminating a substantial portion of the oxygen content of the container to enhance the oxygen evacuating capability of the device.

Applicant's device is thus capable of packaging a selected item in a container with a controlled atmosphere captured within the container. Applicant's apparatus is capable of continuously conveying the containers along a selected path such that the packaging process is accomplished at a commercially acceptable rate of production. During a substantial portion of the path, a vacuum is applied to one side of a space defined between the containers and a covering material, and a selected gas is introduced into the other side of the space. In a second portion of the path, only the selected gas is introduced into the space, and consequently into the container. This limitation of the application of the vacuum prevents the possible introduction of any unwanted ambient atmosphere as the container is being mated to the covering material, and consequently increases the capability of the apparatus to introduce a controlled, defined atmosphere into each container.

Additional objects, features, and advantages of the invention will be apparent to those skilled in the art upon consideration of the following detailed description of a preferred embodiment exemplifying the best mode of carrying out the invention as presently perceived.

DETAILED DESCRIPTION OF THE DRAWINGS

Figure 1:
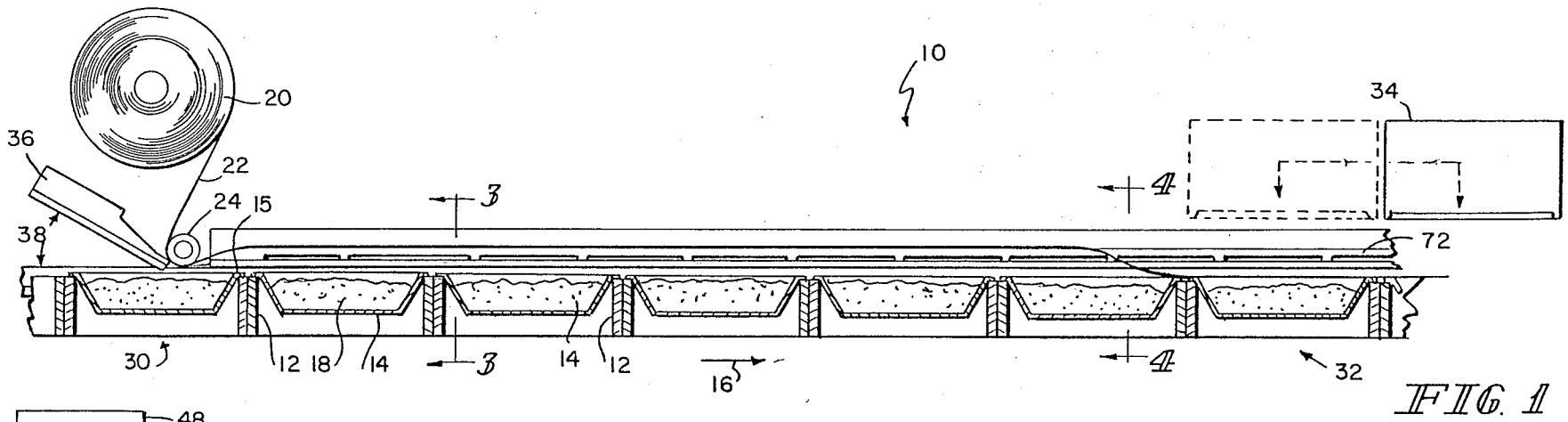
FIG. 1 is a diagrammatic illustration of the packaging device of the present invention in cross section.

Referring now to the drawings, and specifically to FIG. 1, FIG. 1 shows a packaging device 10 according to the present invention. The packaging device 10 includes a plurality of adjacent container supports 12 that are configured to support a series of containers 14 by their rims 15. The container supports 12 and containers 14 ar configured to move in a continuous fashion in the direction of arrow 16. Although the mechanism for moving the container supports 12 and containers 14 in this continuous fashion is not shown, it will be understood that such mechanisms are well known in this art. Each container 14 is shown filled with a selected food product 18. It will be understood that the selected food product 18 has been positioned in each container 14 before the container 14 enters the illustrated packaging device 10 by associated machinery that is not shown. Again, this associated machinery for inserting the selected food product 18 into the containers 14 is well known in this art.

The packaging device 10 includes a covering material or film supply reel 20 that contains a continuous length of film 22. A positioning pulley 24 is oriented to position the film 22 over the stream of moving containers as will be discussed in more detail below. The packaging device 10 also includes a first end 30 that is configured to receive the continuously moving containers 14. The packaging device 10 also has a second end 32 where the film 22 is mated with each container 14 and the containers 14 are discharged onto additional work stations. For illustrative purposes only, a sealing head 34 is shown disposed somewhat above the second end 32. Although only one sealing head 34 is illustrated, it will be understood that more than one sealing head 34 may be utilized. The sealing head 34 is a conventional heat sealing head that operates in a conventional manner to mate a portion of the moving film 22 with an associated moving container 14. Such heat sealing heads 34 are known in this art, and the function of the sealing head 34 will not be described in further detail here.

A second gas introducing member or gas gallery 36 is disposed above the containers 14 at a position substantially adjacent the positioning pulley 24. The gas gallery 36 is oriented at an angle 38 with respect to the path of the containers to introduce a volume of a selected inert gas directly into each container 14 as the container 14 passes through the first end 30 of the packaging device 10. The operation of the gas gallery 36, and its cooperation with the other elements of the packaging device 10 will be discussed below in the discussion related to FIG. 2.

Figure 2:
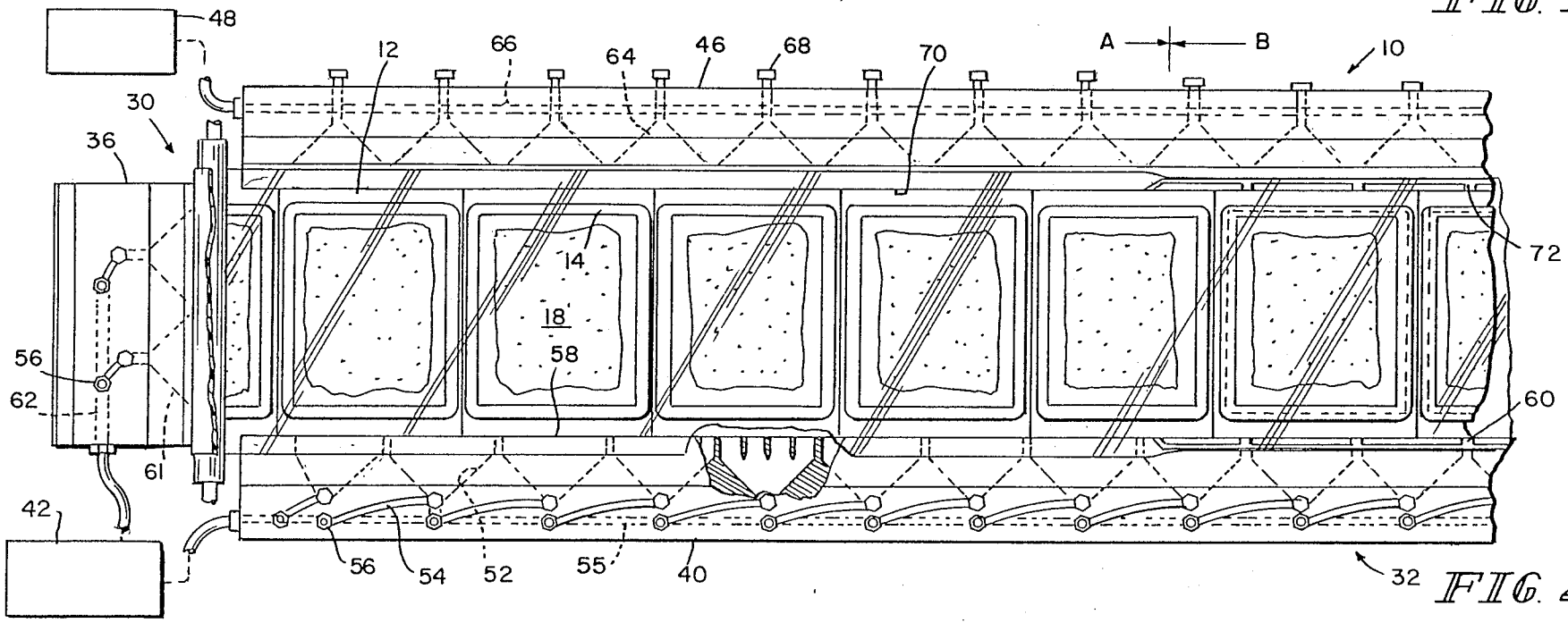
FIG. 2 is a diagrammatic plan view of the packaging device;.

FIG. 2 shows in greater detail the components of the packaging device 10 that cooperate to produce a controlled atmosphere environment in each sealed container 14. An elongated gas gallery 40 is shown disposed along one side of the row of continuously moving containers 14. A gas supply 42 is coupled to the gas gallery 40 to provide gas to the gallery 40 as will be described below. In addition, the gas supply 42 is connected to the gas gallery 36 that is disposed across the first end 30 of the device 10. In the preferred embodiment, the selected inert gas is nitrogen Therefore, the gas supply 42 is a nitrogen supply and provides nitrogen to both tee gas gallery 40 and the gas gallery 36. An elongated vacuum gallery 46 is disposed on the opposite side of the row of continuously moving containers 14. A vacuum source 48 is shown which provides a vacuum to the vacuum gallery 46.

The gas gallery 40 includes a series of expansion chambers 52 with outlets directed toward the row of moving containers 14. Each expansion chamber 52 is coupled by a supply tube 54 to an elongated conduit 55 that extends within the entire length of the gas gallery 40 and receives gas from the gas or nitrogen supply 42. A control valve 56 is provided for each expansion chamber 52 and permits the flow of nitrogen to each chamber 52 to be adjusted individually. Thus, by providing an individual control valve 56 for each expansion chamber 52, the amount of flow of nitrogen into each chamber 52 can be adjusted to any preselected level, or shut completely off if desired.

The inner edge of the gas gallery 40 through which the individual expansion chambers 52 open defines a first side border or boundary means 58 which borders the row of continuously moving containers 14. As illustrated, the first side border 58 extends in parallel relation to the row of continuously moving containers 14. The first side border 58 is substantially vertical near the first end 30 of the device 10, and transitions to an angled face 60 near the second end 32. The function of the angled face 60 will be described in more detail below. The second gas gallery 36 includes two expansion chambers 61 that are similar to the expansion chambers 52. The expansion chambers 61 are coupled to a conduit 62 that receives gas from the gass source 42. Like the gallery 40, control valves 56 are provided to control the flow of gas to each expansion chamber 61.

The vacuum gallery 46 includes a series of vacuum chambers 64 that are similar in shape to the expansion chambers 52 in the gas gallery 40. Each vacuum chamber 64 is coupled to a conduit 66 that extends within the entire length of the vacuum gallery 46 and is coupled to the vacuum source 48. A series of control screws 68 are provided to control and meter the introduction of vacuum from the conduit 66 to each vacuum chamber 64. By providing a control screw 68 for each vacuum chamber 64, the vacuum created within each vacuum chamber 64 can be adjusted to a preselected lever, or it can be shut off completely if desired. The edge of the vacuum gallery 46 extends in parallel relation to the row of moving containers 14 and forms a second side border or boundary means 70. The second side border 70 cooperates with the first side border 58 to form boundary means for the row of moving containers 14. Like the first side border 58, the second side border 70 is vertical along a portion of the vacuum gallery 46 from the first end 30 toward a location approaching the second end 32. At the location approaching the second end 32, the vertical side border 70 transitions to an angled face 72. Like the function of the angled face 60, the function of the angled face 72 will be described below in more detail.

Figure 3:
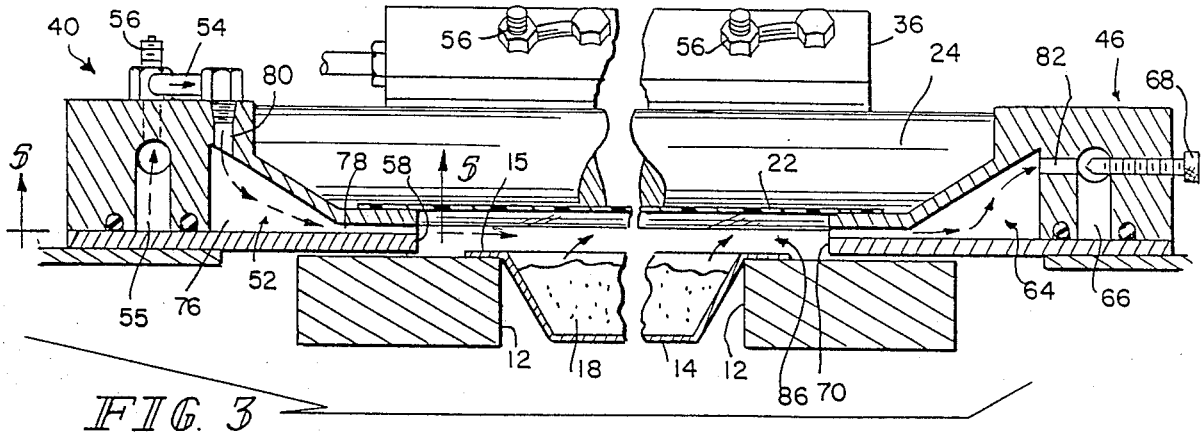
FIG. 3 is a view taken along line 3—3 of FIG. 1 showing selected elements in cross section.

FIG. 3 shows in more detail the orientation of the gas gallery 40, the vacuum gallery 46, the moving film 22, and the moving container supports 12 and containers 14. Specifically, each expansion chamber 52 in the gas gallery 40 includes an expansion volume 76 and a flow directing portion 78. The flow directing portion 78 opens into the first side border 58. Relatively high pressure nitrogen is provided to the expansion volume 76 rom the conduit 55 by the Supply tube 54 through a relatively small orifice 80 formed in the upper rear portion of the expansion chamber 52. The provision of the relatively large expansion volume 76 compared to the size of the orifice 80 permits the high pressure nitrogen to flow into the expansion volume 76 and to expand, thereby lowering its pressure. The resulting low pressure, but high flow of nitrogen is then directed through the flow directing portion 78 outwardly toward the moving containers 14. Because of the orientation of the expansion chambers 52 along the gas gallery 40, the low pressure, high flow of nitrogen creates a sheet or curtain of nitrogen that is directed outwardly away from the gas gallery 40 toward the moving row of containers 14. The characteristics of the flow of nitrogen from each expansion chamber 52 is described and illustrated in more detail below in the discussion related to FIG. 5.

Figure 4:
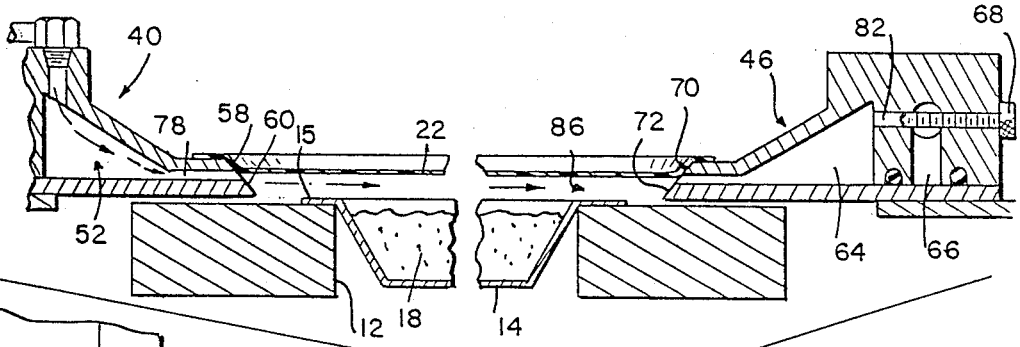
FIG. 4 is a view similar to FIG. 3 taken down stream along line 4—4 of FIG. 1.

Referring to the vacuum gallery 46 opposite the gas gallery 40, vacuum is introduced into each vacuum chamber 64 from the conduit 66 through an orifice 82. As illustrated, the orifice is located in an upper rear portion of the vacuum chamber 64. The control screw 68 for each vacuum chamber 64 and associated orifice 82 controls the introduction of vacuum from the conduit 66 to each vacuum chamber 64. When the control screw 68 is in the open position, out of contact with the orifice 82 (as illustrated in FIG. 3), vacuum is introduced through the orifice 82 to the vacuum chamber 64. When the control screw 68 is moved into engagement with the orifice 82, the vacuum chamber 64 is isolated from the conduit 66 and thus isolated from the vacuum source 48 (as illustrated in FIG. 4).

As discussed, it is advantageous to create a controlled atmosphere within each completed package for several reasons. In the preferred embodiment, where a selected food item 18 is being packaged in a container 14 with a film 22 to cover the container 14, it is advantageous to lower the oxygen content of the package, and to replace the removed oxygen with an inert gas, specifically nitrogen. In order to create the controlled atmosphere within the container 14, the ga gallery 36 first introduces a large quantity of nitrogen directly into the filled container 14 as it enters the first end 30 of the packaging device 10. By introducing a large volume of nitrogen directly into each filled container 14, a substantial portion of the oxygen within the container 14 is expelled. This is especially true of trapped pockets of oxygen that may be existing around the selected food product 18. As each container 14 passes the outlets of the gas gallery 36, the container 14 enters an area or portion o the device 10 where it is bounded on both sides by the gas gallery 40 and the vacuum gallery 46. In addition, the moving film 22 is positioned by the positioning pulley 24 over the moving container 14 and container supports 12 as the container passes under the positioning pulley 24.

After the containers 14 pass the positioning pulley 24, a flush space 86 is created that is bounded below by the container supports 12 and containers 14, at the sides by the first side border 58 and second side border 70, and above by the film 22. Within this space 86 a controlled atmosphere is maintained and enhanced until the film 22 is mated with the container 14 to form a sealed, controlled atmosphere package. To maintain and enhance the controlled atmosphere already introduced into the filled container 14 by the gas gallery 36, nitrogen is introduced into the space 86 from the gas gallery 40, and specifically from the expansion chambers 52. Because of the design of each expansion chamber 52, and because of the orientation of the expansion chambers 52, a substantially continuous curtain of low pressure nitrogen is continuously introduced into the space 86. Simultaneously, a vacuum is created within each vacuum chamber 64 on the opposite side of the pace 86. The vacuum within each vacuum chamber 64 assists in evacuating oxygen from the space 86 and the filled containers 14. By continuously introducing nitrogen from the nitrogen gallery 40, the evacuated oxygen is replaced by the incoming nitrogen. Thus, the simultaneous introduction of nitrogen and creation of a vacuum create and maintain a specified, controlled atmosphere within the space 86, and consequently maintains and enhances the controlled atmosphere within each filled container 14.

The simultaneous application of nitrogen and vacuum is maintained as the containers 14 progrsss toward the second end 32 of the device 10. Referring to FIG. 4, as the containers approach the second end 32 (not shown) of the device 10, the sealing head 34 (not shown) moves downwardly to contact the film 22 and to move the film 22 into sealing engagement with the outer lip 15 of each container. After the sealing head 34 contacts the film 22, and the film 22 begins to be lowered toward the lip 15 of the container 14, it has been found that it is advantageous to discontinue the creation of a vacuum in the vacuum chambers 64 at this time. When the film 22 begins to lower over the outlet of the flow directing portion 78 of each expansion chamber 52, the introduction of nitrogen into the space 86 can be disrupted somewhat. It has been found that if the vacuum is continued, unwanted ambient air can be drawn into the space 86. This would be harmful because the controlled atmosphere created within the space 86 could be adversely affected.

Therefore, as the film 22 begins to lower toward the flow directing portion 78 of the expansion chambers 52, the corresponding opposite vacuum chambers 64 are disabled from creating a vacuum by closing the screws 68. This configuration of the film 22 and corresponding disablement of the vacuum chamber 64 is illustrated in FIG. 4 It will be understood that as the containers progress further toward the second end 32, the film 22 is further lowered to mate with the lip 15 of the container 14 to seal the container 14. Because a controlled atmosphere has been created within the space 86 above and within the container 14, this controlled atmosphere is thus sealed in the container 14 by the film 22 to create a package having a controlled atmosphere environment.

It will be understood from the above discussion that the controlled atmosphere has been created within each container 14 and space 86, and that the containers 14 have been sealed with the film 22 to capture the controlled atmosphere within each container 14 while the containers 14 have been continuously moving along the packaging device 10. Thus, the packaging device 10 of the present invention is able to create and maintain a controlled atmosphere within separate containers 14, and is able to seal the individual containers 14 while the containers 14 are continuously moving along a path in the packaging device 10. Thus, the device 10 of the present invention is able to maintain a high production rate while forming packages containing a controlled atmosphere. In the illustrated embodiment, the packaging device 10 is capable of creating packages in which the oxygen content is reduced to commercially desirable levels. Specifically, it has been found that the packaging device 10 of the present invention is capable of reducing the oxygen content in all package arrangements to less than five percent (5%) oxygen. The present invention is capable of reducing the oxygen content to less than one-half of one percent (0.5%) oxygen when the selected food product is boiled water. These levels of oxygen content are considered to be commercially desirable levels in the food packaging industry.

Continuing to refer to FIG. 4, it has been found that by angling the first side border 58 and second side border 70 to form angled faces 60, 72, respectively, that the transition of the film 22 over the first and second side borders 58, 70, is improved. Specifically, the angled faces 60, 72, permit the film 22 to gradually transition downwardly toward the lip 15 of the container 14. This gradual transition down the angled face 60 results in a smooth interruption of the in-flow of nitrogen from the corresponding expansion chamber 52. By interrupting as smoothly as possible the in-flow of nitrogen from the expansion chamber 52, the controlled atmosphere within the space 86 and container 14 is maintained.

Figure 5:
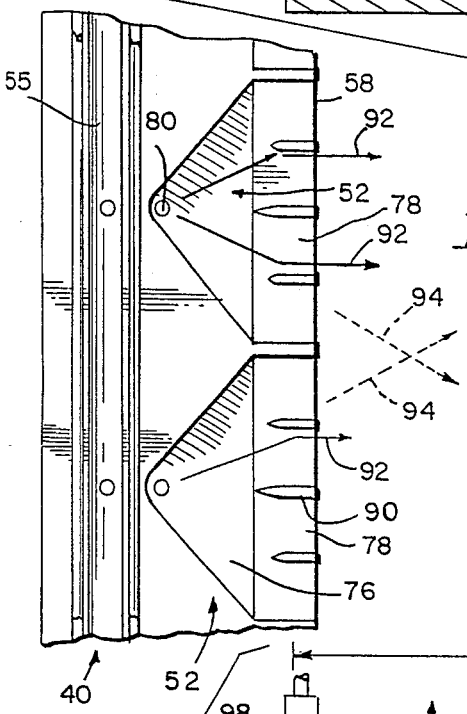
FIG. 5 is a bottom view taken along line 5—5 of FIG. 3.

FIG. 5 illustrates the structure of the expansion chambers 52 and the characteristics of the flow of nitrogen in greater detail. FIG. 5 shows the point of introduction of nitrogen into the expansion chambers 52 through the orifices 80 which are located in an upper rear portion of each expansion chamber 52. As the nitrogen enters each expansion chamber 52 through the orifice 80, it transitions from relatively high pressure, high flow to relatively low pressure, high flow due to the known characteristics of expansion chambers in general. The flow directing portion 78 of each expansion chamber 52 includes three flow dividers or standoffs 90. The flow dividers 90 assist in directing the flow of nitrogen outwardly from the expansion chambers 52. Specifically, the flow dividers 90 act to direct the flow of nitrogen away from the flow directing portions 78 at substantially right angles. This flow of nitrogen from the flow directing portions 78 is illustrated by the solid arrows 92.

By providing low pressure flow of nitrogen, and by accurately directing and controlling the flow of nitrogen from the flow directing portion 78, a laminar flow of nitrogen out of the expansion chambers 52 is achieved. This laminar flow of nitrogen is advantageous because it creates a low pressure curtain of nitrogen toward and into the space 86. By creating a laminar flow of nitrogen, turbulence is substantially eliminated in the out-flow of nitrogen from the flow directing portion 78. This lack of turbulence assists in maintaining the controlled atmosphere within the space 86. The broken arrows 94 indicate flow patterns that could otherwise take place were it not for the flow dividers 92. As illustrated by the broken arrows 94, the flow without the flow dividers 90 would not occur at right angles to the flow directing portions 78, and would not create the desired curtain of low pressure nitrogen with substantially no turbulence.

Figure 6:
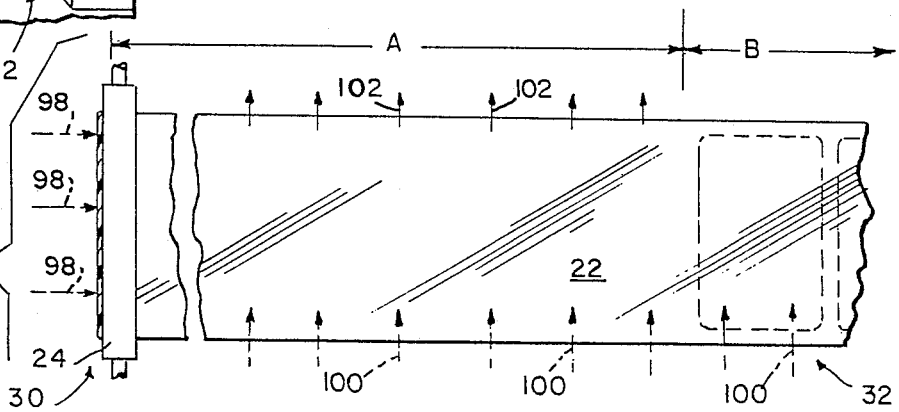
FIG. 6 is a diagrammatic illustration of the fluid flow characteristics of the present invention.

Referring to FIG. 6, FIG. 6 illustrates the orientation of the first portion of the travel of the containers from the first end 30 toward the second end 32. Specifically, the flow path of the containers 14 has been divided for illustrative purposes into section A and section B. In section A, as illustrated in FIG. 3, the film 22 is positioned to create the space 86, and nitrogen is introduced into the space 86 as illustrated by arrows 100. In addition, vacuum is simultaneously created as indicated by the arrows 102. In addition, at the first end 30, nitrogen is introduced by the gas gallery 36 as indicated by arrows 98. In section B, the film 22 has been lowered toward the container 14 as illustrated in FIG. 4. At this point, the vacuum is disabled as indicated by the absence of arrows on the vacuum side.

However, introduction of nitrogen is continued in section B as indicated by the continuing arrows 100. Thus, in section B, the in-flow of nitrogen is continued as the film 22 mates with the lip 15 of the container 14 to create the sealed package having a controlled atmosphere. By maintaining the in-flow of nitrogen during the sealing process, the possibility of the introduction of any ambient atmosphere to degrade the controlled atmosphere is minimized.

Thus, the packaging device 10 of the present invention is capable of creating a controlled atmosphere in a series of continuously moving containers filled with a specified product. It will be understood that the present invention is not limited to packages containing food products. In addition to food products, other products and devices may be advantageously packaged in a controlled atmosphere environment. Examples of these devices and products are medical materials, medicine, certain adhesives, and certain explosive products. With modifications, the present invention is capable of packaging such products and devices in a controlled atmosphere package.

Other modifications may include, for example, introducing gas along both sides of the continuously moving containers. In order to introduce gas along both sides of the moving containers, the vacuum gallery may be eliminated and replaced with a gas gallery. Alternatively, the vacuum gallery may be modified and connected to the gas supply, with the packaging device thus providing gas along both sides of the moving containers. This provision of gas introduction along both sides of the moving container may be advantageous when the containers are relatively deep and have steep side walls, or when the packaging device is conveying multiple rows of containers, with the rows of containers in parallel relation. In these configurations, providing for gas introduction along both sides of the moving containers may increase the capability of the packaging device to provide a controlled atmosphere within the containers.

Although the invention has been described in detail with reference to a preferred embodiment, variations and modifications exist within the scope and spirit of the invention as described and defined in the following claims.

What is claimed is:

1. An apparatus for packaging an item in a controlled atmosphere enclosure, the apparatus comprising, means for continuously conveying a series of containers along a path, the path having sequentially oriented first and second portions, and defining a first side border and an opposite side border, means for introducing a continuously moving covering material over said path of continuously conveyed containers such that a space is created between said continuously conveyed containers and said continuously moving covering material, means disposed substantially adjacent said first border for continuously applying a vacuum only in said first portion of said path to said space above said continuously conveyed containers, first means disposed substantially adjacent said second border for continuously introducing a gas into said space above said continuously conveyed containers in both said first portion and in said second portion of said path, means for mating and sealing said continuously conveyed containers with a corresponding section of said continuously moving covering material in said second portion of aid path to form a controlled atmosphere environment in the enclosure.

2. The system of claim 1, wherein the path includes a first end configured to receive the series of containers, and wherein the apparatus further comprises second gas introducing means disposed substantially adjacent the first end of the path and extending between the first border and the second border for introducing the selected gas into the first end of the path so that the gas is able to communicate with the interior region of each container as the containers enter the path through the first end.

3. A system for controlling the environment in a stream of continuously moving containers, each container having a wall configured to define an interior region and an open end, the system comprising closure means for selectively closing the open end of each container, support means for supporting each container in aligned relation to present each open end toward the closure means in spaced-apart relation thereto, first boundary means for providing a first edge bordering on one side of the stream of continuously moving containers and extending between the support means and the closure means, second boundary means for providing a second edge bordering on the other side of the stream of continuously moving containers and extending between the support means and the closure means the first and second boundary means being arranged in spaced-apart relation to position the open ends of the containers therebetween and cooperating with the support means, certain of the containers in the support means, and the closure means to define passageway means having a selected length, conveyor means for continuously moving the support means to transport the stream of containers through the passageway means at a selected rate, first gas supply means extending through the first edge for introducing gas into the passageway means so that the gas is able to communicate with the interior region of each continuously moving container through its open end as said container move through the passageway means, and vacuum means extending through the second edge for evacuating the passageway means to assist in drawing gas from the first gas supply means into the passageway means and to conduct gas and any other existing atmosphere from the passageway means to the exterior surroundings so that the environment in the interior region of the continuously moving containers exiting the passageway means is a selected gas composition consisting essentially of said gas introduced into the passageway means via the first gas supply means.

4. The system of claim 3, wherein the passageway means is configured to include an inlet for receiving transported containers and an outlet for discharging transported containers, and further comprising second gas supply means extending between the first and second boundary means for introducing gas into the inlet of the passageway means to flood the inlet with said gas during movement of containers therethrough, thereby aiding in preventing induction of atmosphere other than said gas into the passageway means through the inlet due to operation of the vacuum means.

5. A system for defining a selected gas environment in a continuously moving stream of containers, each continuously moving container having a wall configured to define an interior region and an opening, the system comprising passageway means for providing an environment space surrounding the open end of a selected number of containers ion the continuously moving stream of containers so that the environment space is in fluid communication with the interior region of said selected number of continuously moving containers, the passageway means including inlet means for receiving the continuously moving stream of containers, outlet means for discharging the continuously moving stream of containers, and first and second boundary means extending between the inlet and outlet means in a spaced-apart relation for defining opposing first and second side walls of the passageway means, first gas supply means for introducing a gas into the passageway means via the inlet means to flood the passageway means with gas so that gas is introduced into the interior region of each container in the continuously moving stream of containers each container having its open end in communication with the environment space to define the selected gas environment, and space-flushing means extending through at least one of the first and second side walls for maintaining the selected gas environment in the environment space so that the interior region of each container in the continuously moving stream of containers upon initial filling with gas due to operation of the first gas supply means remains substantially free of other atmospheric gases while the open end of each such continuously moving container is in fluid communication with the environment space.

6. The system of claim 5, wherein the passageway means further comprises closure means for selectively closing the open end of each container, support means for supporting each container in aligned relation to present each open end toward the closure means in spaced-apart relation, the closure means and support means cooperating to define said environment space.

7. The system of claim 6, wherein the closure means includes a film and means for selectively applying the film to the container in sealing relation to cover the open end and sealingly capture the selected gas environment therein.

8. The system of claim 5, wherein the space-flushing means includes second gas supply means extending through the first side wall for introducing gas into the environment space so that gas is able to communicate with the interior region of each container through its open end during movement of the stream of containers and vacuum means extending through the second side wall for evacuating the environment space to assist in drawing gas from the second gas supply means into the environment space and to conduct any other atmospheric gases and gas introduced via the first and second gas supply means from the environment space to the exterior surroundings so that the environment in the interior region of containers exiting the passageway means consists essentially of said selected gas environment.

9. The system of claim 8, wherein the passageway means further comprises closure means for selectively closing the open end of each container, support means for supporting each container in aligned relation to present each open end toward the closure means in spaced-apart relation, the closure means and support means cooperating to define said environment space.

10. The system of claim 9, wherein the closure means includes a film and means for selectively applying the film to the container in sealing relation to cover the open end and sealingly capture the selected gas environment therein.

11. The system of claim 8, wherein the first and second gas supply means are aligned in substantially perpendicular relation so that gas directed by the first gas supply means flows in a first direction and gas directed by the second gas supply means flows in a second direction at right angles to the first direction.

12. The system of claim 11, further comprising means for moving the containers along a predetermined movement plane, the second gas supply means being situated to direct the flow of gas in a transverse flow plane in substantially spaced-apart parallel relation to said predetermined movement plane, the first gas supply means being oriented at a predetermined angle with respect to the second gas supply means to direct the flow of gas from the first gas supply means in a longitudinal flow plane oriented to intersect said predetermined movement plane and said transverse flow plane.

13. The system of claim 8, wherein the first gas supply means includes a gas discharge nozzle having a discharge opening of a width sufficient to extend at least between the pair of sides of each container moving along the path so that gas is introuced into the container region along the full lateral width of each container.

14. The system of claim 13, further comprising conveyor means for moving the containers along a predetermined plane, the gas discharge nozzle being oriented at a predetermined dihedral angle in relation to the predetermined plane so that gas introduced from the first gas supply means is aimed relative to the stream of containers to enter the interior region at a selected angle, thereby enhancing development of the selected environment in the interior region of each container.

15. A system for providing a selected environment to a stream of containers continuously moving along a path, each container having a wall configured to define an interior region having a top opening, a leading end, a trailing end, and a pair of sides extending between the leading and trailing ends, the system comprising means for introducing a continuously moving covering material over the path of continuously moving containers such that a space is created between said continuously moving containers and the continuously moving covering material, first gas supply means extending across the path to overlie leading and trailing ends of each container continuously moving along the path for introducing gas into the interior region of each container continuously moving along the path to provide the selected enviornment, second gas supply means extending a predetermined distance along at least one side of the path for directing flow of a gas from one side of the continuously moving container toward the other side across the top opening of the continuously moving container in said space to provide a layer of said gas in said space above the top opening to aid in maintaining the selected environment in the interior region of the continuously moving container, and vacuum means extending a predetermined distance along the other side of the path opposite the second gas supply means for evacuating said space to assist in drawing gas from the second gas supply means into said space and to conduct gas and any other existing atmosphere from said space to the exterior surroundings.

16. In a heat seal machine for sealing a continuously moving series of containers filled with a selected food product, the containers continuously moving along a path bounded by a first side border and an opposite second side border and having a first end for receiving the series of continuously moving containers, the improvement comprising, means disposed along tee first border for applying a vacuum along at least a portion of the path, first means disposed along the second side border for introducing a selected gas into the path, and second means disposed across the first end of the path and extending transversely between the first border and the second border for introducing the selected gas into the continuously moving containers as the containers pass the first end of the path.

17. The improvement of claim 16, wherein the path is separated into sequential first and second portions and wherein applying means operates to apply a vacuum only in the first portion of the path and the first introducing means operate to introduce the selected gas into both the first and second portions of the path.

* * * * *

UNITED STATES PATENT AND TRADEMARK OFFICE

CERTIFICATE OF CORRECTION

PATENT NO. : 4,791,775

DATED : December 20, 1988

INVENTOR(S) : Glen Raque and Edward A. Robinson

It is certified that error appears in the above-identified patent and that said Letters Patent is hereby corrected as shown below:

At column 2, line 3, please delete "move" and insert therefor --over--;

At column 3, line 29, please delete "ar" and insert therefor --are--;

At column 4, line 15, please delete "tee" and insert therefor --the--;

At column 4, line 48, please delete "gass" and insert therefor --gas--;

At column 4, line 61, please delete "lever" and insert therefor --level--;

At column 5, line 16, please delete "rom" and insert therefor --from--;

At column 5, line 56, please delete "ga" and insert therefor --gas--;

At column 5, line 65, please delete "o" and insert therefor --of--;

UNITED STATES PATENT AND TRADEMARK OFFICE

CERTIFICATE OF CORRECTION

PATENT NO. : 4,791,775

DATED : December 20, 1988

INVENTOR(S) : Glen Raque and Edward A. Robinson

It is certified that error appears in the above-identified patent and that said Letters Patent is hereby corrected as shown below:

At column 6, line 21, please delete "pace" and insert therefor --space--;

At column 6, line 32, please delete "progrsss" and insert therefor --progress--;

At column 9, line 4, after the word "opposite", insert the word --second--;

At column 9, line 22, please delete "aid" and insert therefor --said--;

At column 11, line 54, please delete "introuced" and insert therefor --introduced--; and At column 12, line 45, please delete "tee" and insert therefor --the--.

Signed and Sealed this

Sixteenth Day of May, 1989

*Attest:*

DONALD J. QUIGG

*Attesting Officer*

*Commissioner of Patents and Trademarks*